US006279529B1

(12) United States Patent
Komatsu et al.

(10) Patent No.: US 6,279,529 B1
(45) Date of Patent: Aug. 28, 2001

(54) CAM AND TAPPET CARRIER FOR ENGINE

(75) Inventors: Kenji Komatsu; Hideo Fujita; Hidetoshi Kageyama, all of Iwata (JP)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 0 days.

(21) Appl. No.: 09/658,611

(22) Filed: Sep. 8, 2000

(30) Foreign Application Priority Data

Sep. 27, 1999 (JP) ..... 11-272200

(51) Int. Cl.[7] ..... F01L 3/00
(52) U.S. Cl. ..... 123/193.5; 123/90.27
(58) Field of Search ..... 123/193.5, 193.3, 123/90.27, 90.48

(56) References Cited

U.S. PATENT DOCUMENTS 5,080,057 * 1/1992 Batzill et al. ..... 123/193.5
5,094,197 * 3/1992 Rosa ..... 123/90.27
5,522,354 * 6/1996 Sakamoto et al. ..... 123/19.35
5,651,337 * 7/1997 Regueiro ..... 123/90.27
5,921,210 * 7/1999 Regueiro ..... 123/90.27

* cited by examiner

*Primary Examiner*—Marguerite McMahon
(74) *Attorney, Agent, or Firm*—Ernest A. Beutler

(57) ABSTRACT

A cylinder head constructions wherein the cylinder head is comprised of a main cylinder head member that slidably supports the valves for the engine, and which has an upper peripheral edge that defines a cam chamber. At least one camshaft and the tappets associated thereby are supported by a separate cam and tappet carrier member that is affixed to the main cylinder head member. The bearing surfaces for the camshaft are formed at longitudinally spaced points and the valves for the corresponding cylinder are disposed between those points and are in parallel relation but have a large diameter and their actuating tappets have a large diameter but do not encroach on the bearing surfaces for the camshaft.

10 Claims, 3 Drawing Sheets

CAM AND TAPPET CARRIER FOR ENGINE

This invention relates to a valve actuating mechanism for an internal combustion engine and, more particularly, to an improved cylinder head and valve actuating system for an overhead camshaft internal combustion engine.

It is well recognized that the performance of internal combustion engines can be improved through the use of overhead valves operated by overhead mounted camshafts. When an overhead camshaft arrangement is employed, the cylinder head assembly trends to become much more complicated than with a conventional pushrod operated engine. This is because the cylinder bead must, in addition to supporting the valves and the valve springs, provide support for the camshaft and for the actuators for the valves. Frequently, the valves are directly operated and this means that an arrangement must be provided for slidably supporting the thimble tappets that operate the individual valves from the camshaft.

If all of these functions are performed primarily by the cylinder head, then the cylinder head casting becomes extremely complicated. In addition, since it is necessary to machine the bearings for the camshaft provided by the cylinder head, and the bores for slidably supporting the tappets, than machining operations also add significantly to the cost of the cylinder head. Furthermore, there is the problem of assembly of all of components into such a unitary cylinder head assembly, and the problems of accessibility the various fasteners for securing the cylinder head to the cylinder block and the bearing caps to the cylinder head for journaling the camshaft. Of course, the problems mentioned above are complicated when the engine employs twin overhead camshafts.

It has been proposed, therefore, to employ a construction wherein the main cylinder head member itself does not have to perform all of these functions. For example, in U.S. Pat. No. 4,612,885, entitled "Camshaft Bearing Arrangement For Overhead Cam Engine", issued Sep. 23, 1986, in the name of Masaaki Yoshikawa, and assigned to the assignee hereof, there is depicted a cylinder head arrangement wherein the main cylinder head assembly only supports the poppet valves for their movement and the return springs for the poppet valves. The camshafts and valve actuating tappets are supported in a separate cam carrier that is affixed to the cylinder head and thus can be machined and cast separately simplifying the aforenoted problems. However, with the arrangement shown in that Patent, the cam carrier forms the outer periphery of the cylinder head and the cam cover must sealingly engage it. In addition, the cam carrier must have a sealing arrangement around its outer periphery with the upper surface of the cylinder head to afford sealing. Hence, substantial addition machining operations are required.

Another arrangement has been proposed which offsets or avoids certain of the difficulties in connection with the structure shown in U.S. Pat. No. 4,612,885 and which problems are noted in the preceding paragraph. This construction is described in co-pending application Ser. No: 09/624,709, which application is a continuation of co-pending application of the same title, filed Jun. 7, 1995, which application is a division of co-pending application Ser. No. 08/145490, filed Oct. 29, 1993, now issued as U.S. Pat. No. 5,522,354, all assigned to the assignee hereof.

In connection with the constructions shown in that co-pending application, there is provided a cam and tappet carrier member that is comprised of a plurality of longitudinally spaced bearing portions which provide bearings for the camshaft and which are interconnected by longitudinally extending bridging portions that define bores that slidably receive the tappets for actuating the associated valves. In all instances shown in that application where the bearing members are spaced at the opposite sides of the cylinder bore, there are provided three intake valves that are staggered relative to the cylinder bore and hence, the size of the valve and size of the tappets can be maintained quite large without minimizing or requiring cut-outs in the bearing area. However, when there are employed only two valves per cylinder or where two valves having parallel axes are disposed adjacent each other, it is more difficult to maintain large valve areas and also large tappet bearing areas without encroachment to and reduction in the size of the camshaft bearing surface.

It is, therefore, a principal object of this invention to provide an improved cylinder head assembly for an overhead camshaft internal combustion engine.

It is a further object of this invention to provide an improved cylinder head assembly for an overhead cam internal combustion engine wherein at least some of the valve actuating tappets and at least one of the camshafts are supported by a separate cam carrier member that is affixed to the cylinder head but in such a way that this cam carrier member need perform no sealing functions for the overall cylinder head assembly.

It is a further object of this invention to provide an improved and simplified cylinder head assembly for an internal combustion engine having an overhead camshaft wherein machining and assembly operations are considerably simplified.

It is yet a further object to this invention to provide an improved cam and tappet carrier member where the bearing surfaces for the camshaft are formed at longitudinally spaced points and the valves for the corresponding cylinder are disposed between those points and are in parallel relation but have a large diameter and their actuating tappets have a large diameter but do not encroach on the bearing surfaces for the camshaft.

SUMMARY OF THE INVENTION

This invention is adapted to be embodied in a cam and tappet carrier member that is associated with cylinder head member to form a cylinder head assembly for an overhead camshaft engine. The cam and tappet carrier member is affixed to the cylinder head member within the cam chamber and defines at least a pair bearing surfaces for journaling a camshaft on opposite sides of a cylinder bore axis. These bearing surfaces are integrally connected by a bridging member that defines at least a pair of tappet bores each of which receives a respective tappet actuated by the camshaft for operating a respective one of a pair of valves supported by the main cylinder head member and serving the cylinder bore. The bridging member defines at least two parallel bores having their axes lying in a common plane for reciprocally supporting thimble tappets. The thimble tappets are associated with valves that are mounted in the cylinder head and associated with the respective cylinder. The axes of the stems of the valves are offset from the axes of the tappet receiving bores in a direction spaced outwardly toward the cam bearing surfaces so as to permit a large valve size and also to permit a large tappet diameter without encroaching upon the cam bearing surfaces.

DETAILED DESCRIPTION OF THE PREFERRED EMBODIMENT OF THE INVENTION

Figure 1:
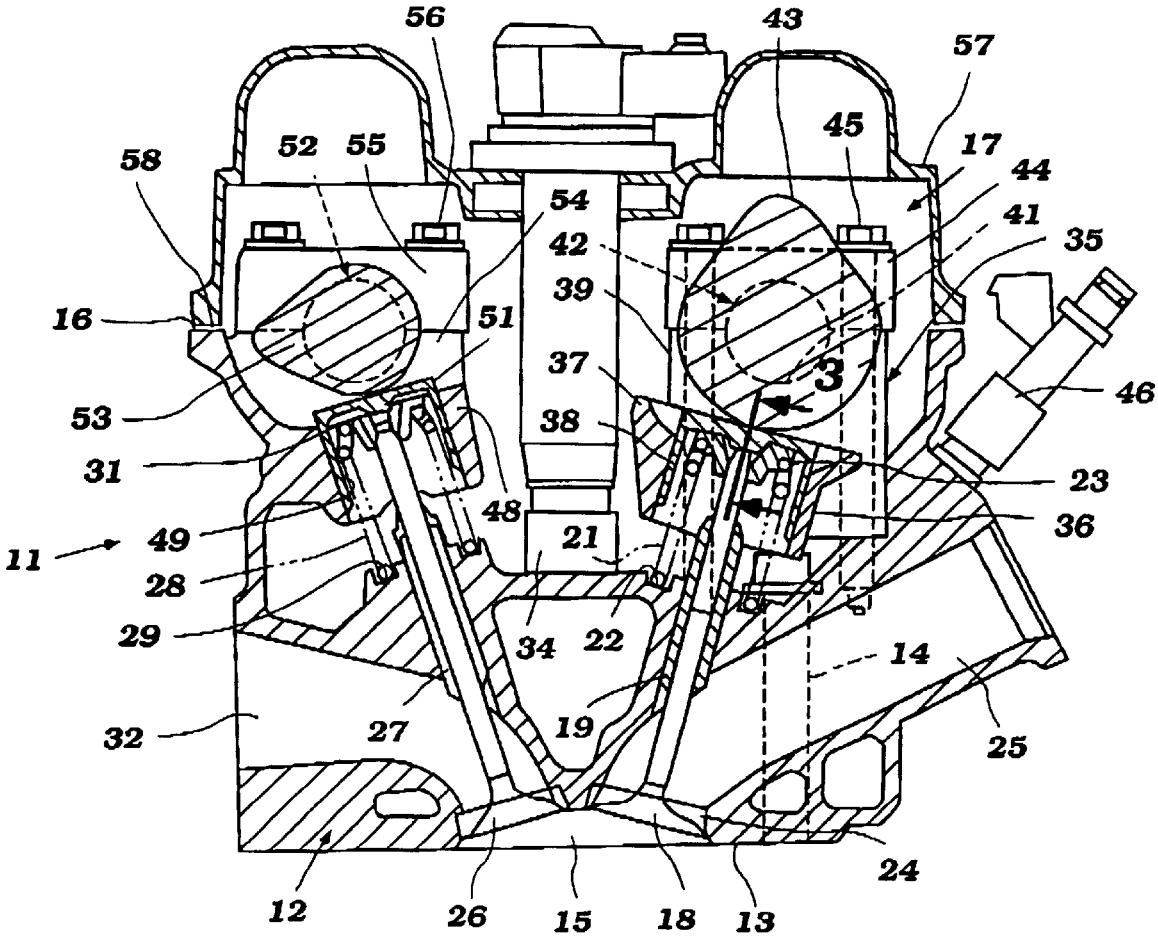
FIG. 1 is a cross sectional view of a cylinder head assembly constructed in accordance with an embodiment of the invention and taken along the line 1—1 of FIG. 2.

In the drawings, only a portion of the cylinder head assembly of an internal combustion engine is depicted and this portion of the cylinder head assembly is not shown attached to the cylinder block, piston and remaining portions of the engine, which may be considered to be conventional. Also, it is not believed necessary to show all cylinders of the engine because those skilled in the art will readily understand how the invention may be employed in conjunction with multiple cylinder engines. In addition, it is to be understood that the cylinder head assembly depicted may be the cylinder head assembly for an in-line engine or for one bank of a V-type or opposed engine. Again, it is believed that those skilled in the art can readily understand how the invention can be applied to such engines.

Referring now in detail to the drawings, a cylinder head assembly constructed in accordance with this embodiment is identified generally by the reference numeral 11. The cylinder head assembly 11 includes a number of parts, to be described including a main cylinder head member 12 which is formed conveniently as a casting and may be made from a light weight material such as aluminum, aluminum alloys or the like.

The main cylinder head member 12 has a lower sealing surface 13 that is adapted to be affixed to an associated cylinder block by means such as socket headed screws 14 or the like. The socket headed screws 14 are disposed around a depressed central area 15 (FIGS. 3 and 3) of the cylinder head surface 13 that is adapted to cooperate with the associated cylinder bore to form the combustion chamber thereof, along with the piston and cylinder bore.

The main cylinder head member 12 is also provided with an upper peripheral sealing surface 16, which surrounds a cam chamber 17 in which a valve actuating mechanism (to be described) is contained.

The cylinder head assembly 11 is of the twin overhead cam type embodying a cross flow pattern. To this end, one side, the left side, of the cam chamber 17 comprises the intake side and the other side of the cam chamber 17 comprises the exhaust side.

A plurality of intake valves 18 are supported for reciprocation in the main cylinder head member 12 by means of valve guides 19 that are pressed in place. In the illustrated embodiment, there are provided two intake valves for each combustion chamber recess 15. It should be readily apparent to those skilled in the art, however, that the invention can be employed with engines having different numbers of intake valves. The invention, however, has particular utility with multiple valve engines because it easily facilitates the use of actuating mechanisms for such multiple valves.

Each intake valve 18 is biased toward its closed position by means of a coil compression spring 21 that bears against machined surfaces 22 of the main cylinder head member 12. The other ends of the coil springs 21 acts against keeper retainer assemblies 23 that are affixed to the upper ends of the stems of the valves 18. As a result of this construction, the intake valves 18 are all biased to a closed position, as is well known in this art. The intake valves 18 are opened in a manner, which will be described.

The heads of the intake valves 18 cooperate with valve seats 24 that are pressed or otherwise held in place in the cylinder head member 12 and which are formed at the termination of intake ports 25 that extend through the intake side of the main cylinder head member 12. The intake ports 25 may be either individual for each intake valve 18 or may be Siamese in a desired grouping, as shown in the illustrated embodiment.

Turning now to the exhaust side of the main cylinder head member 12, this includes a plurality of poppet type exhaust valves 26 which have there stems slidably supported in valve guides 27 that are pressed into the main cylinder head members 12. In the illustrated embodiment, there are two exhaust valves per cylinder, but, like the intake valves 18, it is to be understood that the invention may be employed in conjunction with engines having any number of exhaust valves. As with the intake valves, however, the invention has particular utility with multiple valve engines.

Coil compression springs 28 encircle the stems of the exhaust valves 26 and engage at one end machined surfaces 29 of the main cylinder head member 12. The opposite sides of these springs 28 are retained to the stems of the exhaust valves 26 by keeper retainer assemblies 31. Single or Siamese exhaust ports 32 extend from the valve seats to an exhaust system (not shown).

The area between the intake and exhaust sides of the main cylinder head member 12 is provided with a plurality of spark plug wells 33, one for each combustion chamber recess 15 to accommodate a spark plug 34 that is threaded into a tapped opening formed at the base of the well 33 so that the gap of the spark plug 34 will be disposed substantially centrally in the combustion chamber recess 15.

The mechanism for actuating the intake valves 18 will now be described, and this includes a combined cam and tappet carrier member, indicated generally by the reference numeral 35. The carrier member 35 embodies important features of the invention and may be formed as a casting from a lightweight material such as aluminum or aluminum alloy. The carrier member 35 has tappet supporting, bridging portions 36 that are provided with machined bores 37 for receiving a tumble type tappets 38 associated with each of the intake valves 18. Since the carrier member 35 is a separate piece, these tappet receiving bores 37 may be easily machined.

The carrier member 35 is also provided with camshaft lower bearing portions 39 which are disposed between adjacent cylinders and which provide bearing surfaces 41 (FIG. 1) for the rotatably journaling the bearing portions of an intake camshaft 42 which has individual cam lobes 43 (FIG. 1) that cooperates with the thimble tappets 38 for opening the intake valves 18 in a well known manner.

Individual bearing caps 44 are affixed to the carrier member 35 and also affixed to this assembly to the cylinder head member 12 by means of bolts 45. Locating pins (not shown) may be provided at spaced locations to facilitate alignment. The rotational axis thus defined for the intake camshaft lies in a common plane containing the axes of reciprocation of both the tappets 38 and the intake valves 18 and is perpendicular to these axes.

It should be noted that the cam bearing portions 39, and, specifically, the bearing surfaces 41 overly the cylinder head hold down bolts 14. In order to permit retorqueing of these bolts 14 without removing the engine carrier assembly, the carrier member bearing surfaces 41 may be provided with through bores (not shown) through which a tool may be passed so as to torque down the cylinder head fastener 14 on the intake side.

It should be readily apparent that the intake side of the cylinder head assembly 11 can be easily assembled by placing the intake valves 18 in place with their springs 21 and retainers 23 before the carrier member 35 is installed. Although the upper lower and bearing surfaces 41 of the carrier member are parallel to the lower sealing surface 13 of the cylinder head while the tappet bores 37 are disposed at an angle, this later assembly presents no problem because the tappets 38 can be sized so that they can be in place in the carrier member 35 either before or after the carrier member 35 is placed on the cylinder head member 12. The bores 37 are adequate in size so as to clear the valve spring assemblies during this installation. It should also be noted that the carrier member 35 is disposed inwardly of the cylinder head upper sealing surface 16 within the cam cavity 17 and does not extend above this surface.

It should be readily apparent that since the bridging portions 36 in which the tappet receiving bores 37 are formed are disposed between the camshaft bearing portions 39, the diameter for the tappets 38 is somewhat limited unless the cam bearing portions 39 are cut away to provide a larger diameter. However, this reduces the effective surface of the bearing portions 41 and may not be desired.

Figure 2:
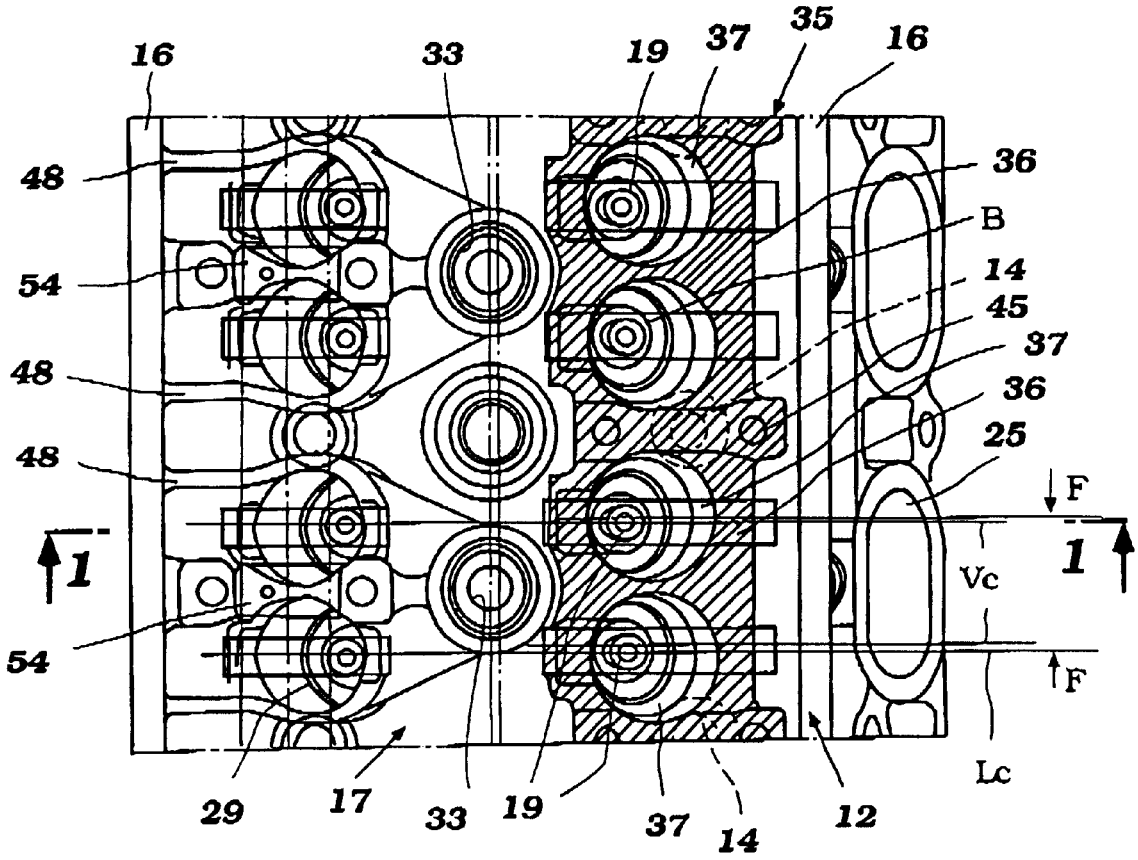
FIG. 2 is a partial top plan view of the cylinder head assembly with the cam cover, camshaft bearing caps and other members removed so as to more clearly show the construction.
Figure 3:
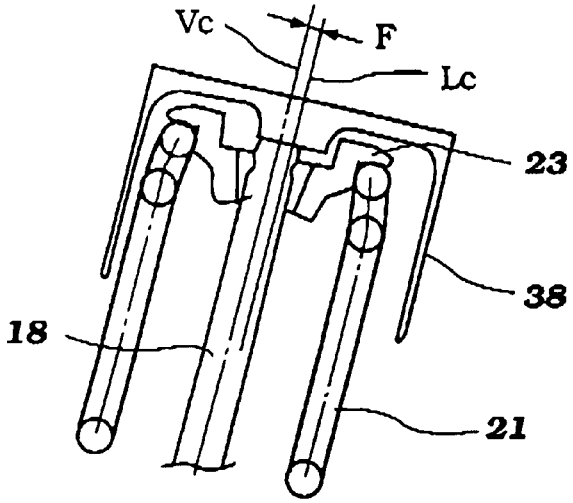
FIG. 3 is a cross sectional view taken along the line 3—3 of FIG. 1 showing the offsetting of the tappet bores relative to the valves to show this feature of the invention.
Figure 4:
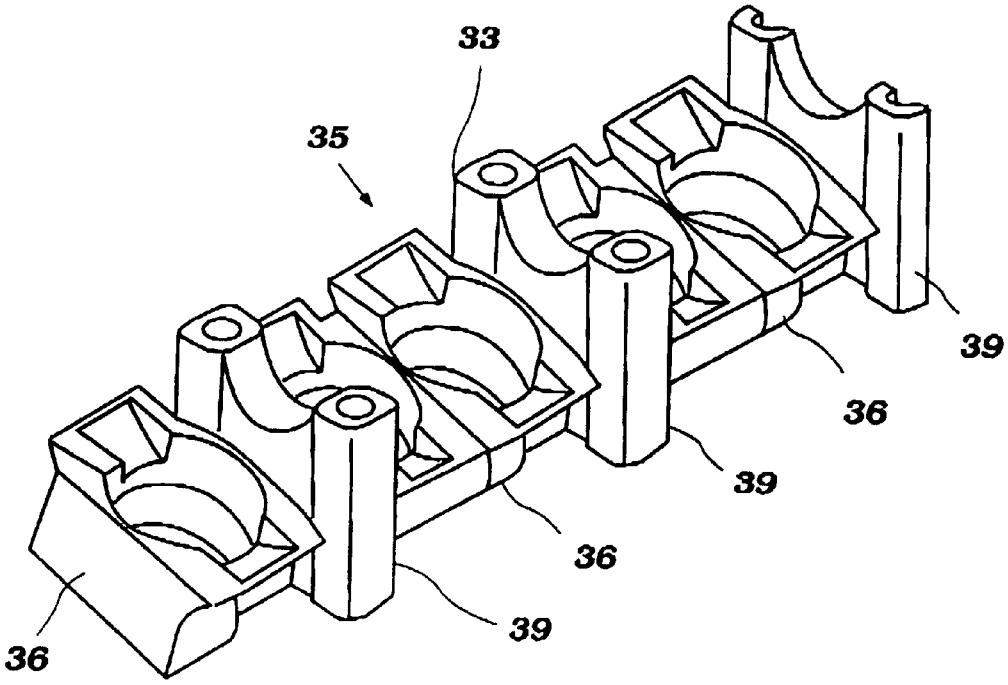
FIG. 4 is a partial, perspective view of the cam and tappet carrier member.

Therefore, an while still maintaining a large size for the heads of the intake valves 18, the tappet receiving bores 37 of the bridging members 36 are offset slightly relative to the center of the valve stems of the intake valves 18 as best seen in FIGS. 2 and 3. In these figures, the center of the valve stem is indicated by the dimension Vc while the center of the tappet 38 and, accordingly, the cam lobe 43 is indicated at Lc. This offsetting "F" in the direction of the length of the engine permits the tappets 38 to be disposed further from the camshaft bearing portions 39 for each cylinder than the valves. Thus, a large tappet area is provided without minimizing the effect that this would have if the valves were equally displaced.

This would provide a small bridging surface in the cylinder head between the heads of the valves 18, which is not desirable, because cracking might occur in this area. Thus, by offsetting the tappet bores relative to the valve stem axes it is possible to maximize bearing areas for the camshaft 42 while at the same time maintaining a large valve diameter without a narrow area in the cylinder head between the intake valve seats 24 which could cause the possibility of cracking.

Finally, it should be noted that the area of the bridging portions 36 surrounding each tappet receiving bore 37 is formed with a slotted area, indicated at 46 in FIG. 1 that permits lubricant to collect around the bores 37 and insure that the tappets are well lubricated.

Turning now to the exhaust side valve of the cylinder head assembly 11 and the actuation for the exhaust valves 26, this is of the conventional type wherein the exhaust camshaft, to be described, and valve actuating thimble tappets are supported within the main cylinder member 12.

The cylinder head member 12 on the exhaust side is provided with pairs of bosses 48 that are bored as at 49 so as to receive thimble tappets 51. These thimble tappets 51 engage the keeper retainer assemblies 31 for operating the exhaust valves 26.

An exhaust camshaft 52 having lobes 53 is journalled in the cylinder head member 12 by bearing portions 54 formed integrally with the exhaust side of the cylinder head assembly between the pairs of bosses 48 for the tappets 51 for each cylinders. Bearing caps 55 are affixed to each of these bosses 54 by threaded fasteners 56 for engaging corresponding bearing surfaces on the exhaust camshaft 52 between the lobes 53 for journaling the exhaust camshaft.

The cam chamber 17 is covered by a cam cover 57 which carriers a sealing gasket 58 around its periphery and which sealingly engages the surface 16 of the cylinder head member 12 to close the cam chamber 17.

It should be readily apparent from the foregoing description of the described embodiment of the invention is very effective in providing a cylinder head assembly that can be easily machined and assembled and, nevertheless, will accommodate a large number of parallel tappets and support the associated actuating camshaft. Also large valve and tappet diameters are possible without reducing the cam bearing surface area. Of course, the embodiment described is only preferred embodiment of the invention, and various changes and modifications may be made without departing from the spirit and scope of the invention, as defined by the appended claims.

What is claimed is:

1. A cam and tappet carrier member for association with a cylinder head member to form a cylinder head assembly for an overhead camshaft engine, said cam and tappet carrier member being adapted to be affixed to the cylinder head member within a cam chamber and defining at least a pair of bearing surfaces for journaling a camshaft on opposite sides of a cylinder bore axis, said bearing surfaces are integrally connected by a bridging member defining at least a pair of tappet bores each of which receives a respective tappet actuated by the camshaft for operating a respective one of a pair of valves supported by the main cylinder head member and serving the cylinder bore, said bridging member defining at least two parallel bores having their axes lying in a common plane for reciprocally supporting thimble tappets, the thimble tappets being associated with valves that are mounted in the cylinder head member and associated with the respective cylinder bore, the axes of the stems of the valves being offset from the axes of the tappet receiving bores in a direction spaced outwardly toward the cam bearing surfaces so as to permit a large valve size and also to permit a large tappet diameter without encroaching upon said bearing surfaces.

2. A cam and tappet carrier member as set forth in claim 1 wherein the bearing surfaces define a rotational axis for the camshaft that is generally perpendicular to the tappet bore axes.

3. A cam and tappet carrier member as set forth in claim 1 wherein the bearing surfaces define a rotational axis for the camshaft that is generally perpendicular to the valve axes.

4. A cam and tappet carrier member as set forth in claim 3 wherein the bearing surfaces define a rotational axis for the camshaft that is generally perpendicular to the tappet bore axes and lies in the plane containing the tappet bore axes.

5. A cylinder head assembly for an overhead camshaft engine comprising a main cylinder head member defining a lower sealing surface for sealing engagement with a cylinder block and at least one portion of said lower surface cooperating with a cylinder bore of the cylinder block to define a combustion chamber, said cylinder head member having an uppermost peripheral surface surrounding a cam chamber and adapted to sealingly engage with a cam cover for enclosing said cam chamber, and a cam and tappet carrier member as set forth in claim 1 affixed to said main cylinder head member within said cam chamber inwardly of said uppermost peripheral surface and below said uppermost peripheral surface so that said uppermost peripheral surface only absorbs the sealing force of said cam cover.

6. A cylinder head assembly for an overhead camshaft engine as set forth in claim 5 wherein the main cylinder head member has a plurality of longitudinally spaced portions each cooperating with a respective cylinder bore and forming a respective combustion chamber, the cam and tappet carrier member providing a plurality of transversely extending members forming a plurality of longitudinally spaced bearing surfaces for the camshaft each formed between adjacent cylinder bores.

7. A cylinder head assembly for an overhead camshaft engine as set forth in claim 6, further including a plurality of bearing caps each affixed to a respective transversely extending member of the cam and tappet carrier member and fastening means for affixing at least partially said bearing caps and said cam and tappet carrier member to said main cylinder head member.

8. A cylinder head assembly as set forth in claim 7 wherein the bearing surfaces define a rotational axis for the camshaft that is generally perpendicular to the tappet bore axes.

9. A cylinder head assembly as set forth in claim 7 wherein the bearing surfaces define a rotational axis for the camshaft that is generally perpendicular to the valve axes.

10. A cylinder head assembly as set forth in claim 9 wherein the bearing surfaces define a rotational axis for the camshaft that is generally perpendicular to the tappet bore axes and lies in the plane containing the tappet bore axes.

* * * * *